US007766103B2

(12) United States Patent
Ravat

(10) Patent No.: US 7,766,103 B2
(45) Date of Patent: Aug. 3, 2010

(54) DRILL BIT AND A SINGLE PASS DRILLING APPARATUS

(75) Inventor: Pierre Ravat, Loyettes (FR)

(73) Assignee: Sandvik Intellectual Property AB, Sandviken (SE)

( * ) Notice: Subject to any disclaimer, the term of this patent is extended or adjusted under 35 U.S.C. 154(b) by 86 days.

(21) Appl. No.: 12/068,950

(22) Filed: Feb. 13, 2008

(65) Prior Publication Data

US 2008/0205994 A1 Aug. 28, 2008

(30) Foreign Application Priority Data

Feb. 14, 2007 (SE) ..... 0700383
Feb. 14, 2007 (SE) ..... 0700384

(51) Int. Cl.
*E21B 10/26* (2006.01)

(52) U.S. Cl. ..... 175/385; 175/398; 175/427; 405/259.1; 411/387.2

(58) Field of Classification Search ..... 175/427, 175/398, 385; 405/259.1; 411/387.2, 387.1, 411/387.5

See application file for complete search history.

(56) References Cited

U.S. PATENT DOCUMENTS

| | | | | |
|---|---|---|---|---|
| 2,673,717 | A * | 3/1954 | Bacon | 175/386 |
| 3,390,730 | A | 7/1968 | Techy et al. | |
| 3,885,638 | A | 5/1975 | Skidmore | |
| 4,461,362 | A * | 7/1984 | Staggs et al. | 175/325.5 |
| 6,309,159 | B1 * | 10/2001 | Weaver et al. | 411/387.5 |
| 6,431,295 | B1 * | 8/2002 | Kleine et al. | 175/415 |
| 6,739,416 | B2 * | 5/2004 | Presley et al. | 175/385 |
| 7,080,697 | B2 | 7/2006 | Mocivnik | |
| 7,392,866 | B2 * | 7/2008 | Brady | 175/427 |
| 2007/0000701 | A1 * | 1/2007 | Weaver | 175/420.1 |
| 2007/0274788 | A1 | 11/2007 | Ravat | |
| 2008/0302577 | A1 * | 12/2008 | Pile | 175/427 |

FOREIGN PATENT DOCUMENTS

| | | |
|---|---|---|
| GB | 1033603 | 6/1966 |
| WO | WO 96/11323 | 4/1996 |
| WO | WO 02/088523 | 11/2002 |
| WO | WO 2005/085582 | 9/2005 |
| WO | WO 2007/030049 | 3/2007 |

* cited by examiner

*Primary Examiner*—Shane Bomar
(74) *Attorney, Agent, or Firm*—Drinker Biddle & Reath LLP

(57) ABSTRACT

A drill bit and a single pass drilling apparatus are disclosed. The one-piece drill bit is rotatable about a drilling axis and has a connection portion, adapted to be rigidly connected to a drill steel, a pilot part and a reamer part. The reamer part has a leading and at least one trailing first rock machining means disposed on one side of the pilot part within a sector defined by sector angle θ. At least one of the trailing first rock machining means is axially spaced from the leading first rock machining means in the direction toward the trailing end of the drill bit.

38 Claims, 3 Drawing Sheets

DRILL BIT AND A SINGLE PASS DRILLING APPARATUS

RELATED APPLICATION DATA

This application claims priority under 35 U.S.C. §119 and/or §365 to Swedish Application No. 0700383-3, filed Feb. 14, 2007, and also to Swedish Application No. 0700384-1, filed Feb. 14, 2007, the entire contents of each of these applications are incorporated herein by reference.

FIELD

The present disclosure relates to a drill bit and a single pass drilling apparatus. More particularly, the disclosure relates to a drill bit having a plurality of rock machining means arranged relative to the direction of rotation and angularly spaced apart from one another about the drilling axis. The disclosure references single pass drilling, however, it is to be appreciated that the drill bit is not limited to that use and may find application in a broad range of drilling operations.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

The installation of anchor bolts to reinforce excavations is usually carried out in two distinct steps. Usually, a bore is drilled and the drill steel and bit extracted before the bolt is inserted into the bore and tightened or grouted. Single pass anchor bolting involves carrying out these two steps simultaneously, with the task of removing the drill steel to insert the bolt being eliminated. The advantages of single pass bolting include minimizing the time required for bolt installation, improving safety for drilling equipment operators, when comparing with manual or semi manual bolting, and enhancing prospects for full automation of the process. A further advantage is improved quality and precision of anchor bolt installation, when comparing with manual or semi manual bolting. The diameter of the bore is critical for anchor bolt performance in the case of friction, e.g. Split set bolts. Still a further advantage with single pass bolting is that the bore cannot collapse when retracting the drill bit since the bolt is already in the bore. This leads to much better efficiency as the bolt is always installed; i.e., there will be no lost holes.

Prior attempts at single pass bolting have generally been targeted at innovative anchor bolts, which also act as the drill steel, having a drill bit provided about an end thereof. Such apparatus are used via a rotational drilling method or a rotary/percussive drilling method and are generally unsuitable for hard ground conditions. Existing hard ground percussive anchor bolts that do not reuse the drill bit suffer from cost problems. A wide variety of roof bolts exist and one particular form is tubular (e.g. split-sets, Swellex, etc. . . . ), having a central bore formed lengthwise through the bolt. Drill bits adapted to be extracted through a casing have been complex and accordingly expensive.

A drill bit has been proposed in Swedish Patent Application No. 0400597-1 that has a reamer part that incorporates rock machining elements which are disposed non-symmetrically about the drill bit axis. This construction allows a bore diameter to be formed that is larger than the diameter of the drill bit, thereby allowing removal of the bit through a casing.

However, the penetration profile of the drill bit has been found to be non-uniform thereby causing stress on the bit which can reduce the bit's efficiency and service life.

Cost competitiveness of drilling speed versus bit cost are complicated in prior single pass anchor bolts due to the use of specialized anchor bolts and the exclusive use of either complex retractable bits. It nevertheless remains the case, that the installation advantages of a self-drilling roof bolt outweigh those of the non-self-drilling type.

SUMMARY

Exemplary embodiments of the disclosed drill bit have as one object to substantially overcome one or more of the above-mentioned problems associated with the prior art, or at least to provide an alternative thereto. Still another object is to provide a drill bit and a single pass drilling apparatus that are more effective and so to make use of single pass bolting in the mining industry more attractive.

An exemplary drill bit rotatable about a drilling axis comprises a bit body, a leading end and a trailing end spaced apart in a direction of the drill axis, and, relative to a direction of rotation, a leading first rock machining means and at least one trailing first rock machining means, the leading first rock machining means and the trailing first rock machining means being disposed on the bit body and angularly spaced apart from one another about the drill axis, wherein at least one of the trailing first rock machining means is also axially spaced from the leading first rock machining means in a direction towards the leading end of the drill bit.

An exemplary single pass drilling apparatus comprises drilling means, an anchor bolt, and an embodiment of a one-piece drill bit as variously disclosed herein.

Throughout the specification, unless the context requires otherwise, the word "comprise", or variations such as "comprises" or "comprising", will be understood to imply the inclusion of a stated integer or group of integers but not the exclusions of any other integer or group of integers.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figures 1A, 1B, 1C, 1D, 1E, 1F, 1G:
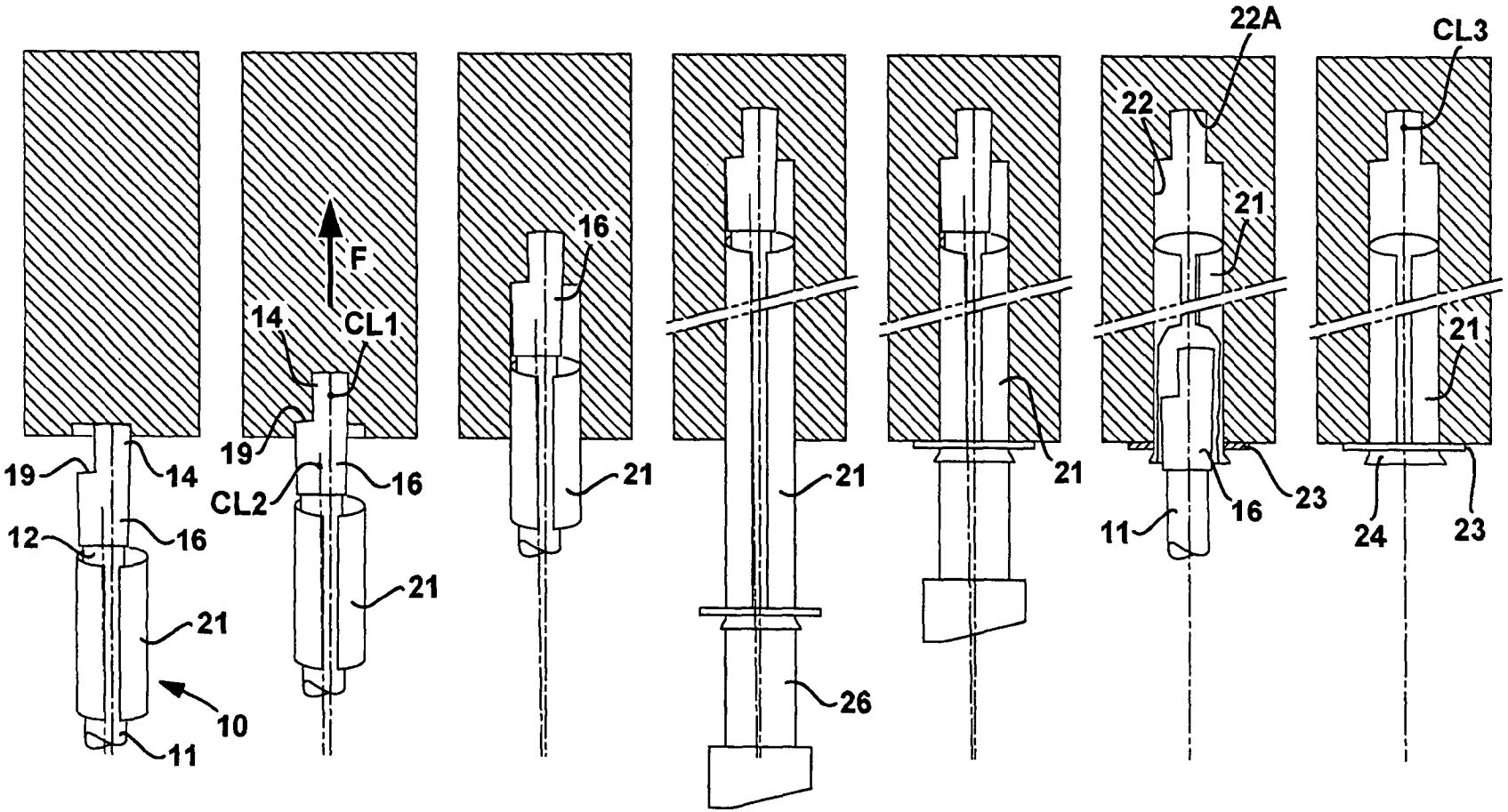
FIGS. 1A-1G schematically show a sequence of single pass roof bolting.
Figure 2A:
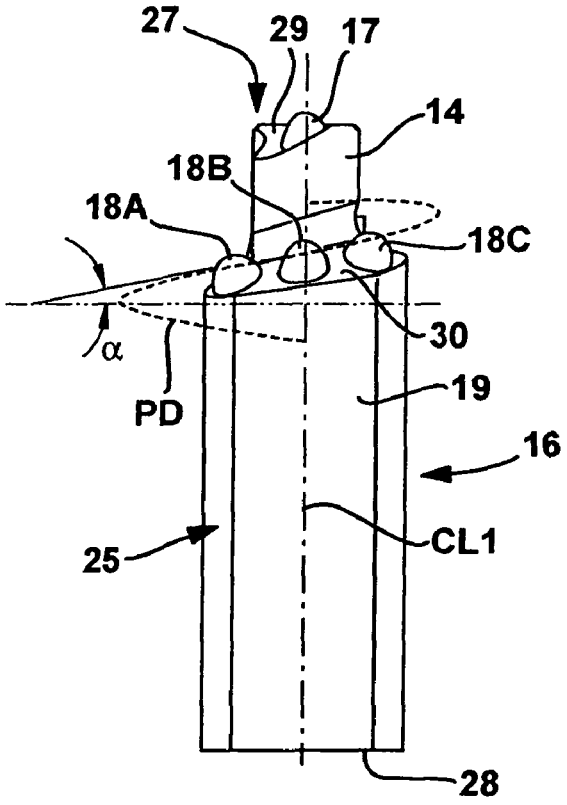
FIG. 2A shows an exemplary embodiment of a drill bit in a front elevational view.
Figure 2B:
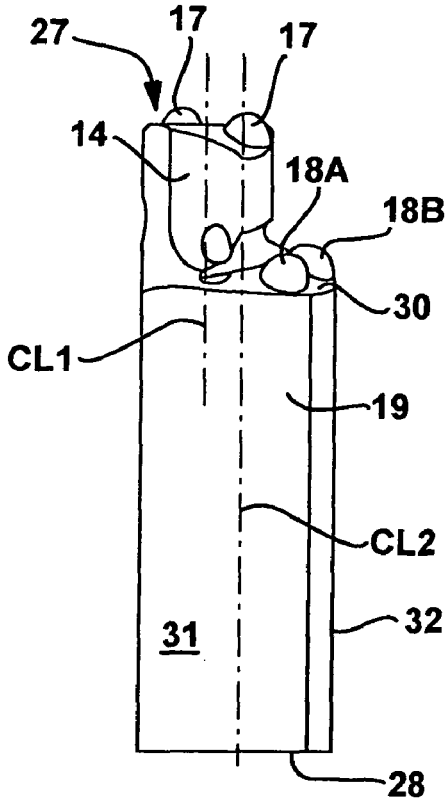
FIG. 2B shows the drill bit of FIG. 2A in a side elevational view.
Figure 2C:
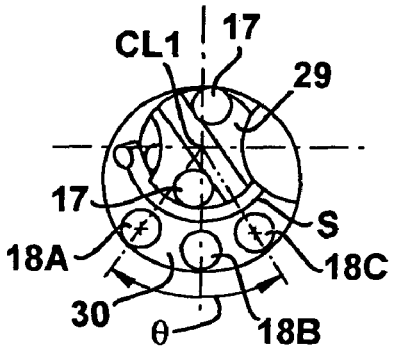
FIG. 2C shows the drill bit of FIG. 2A in a front view.

FIGS. 1A-1G show a single pass drilling apparatus 10 using a drill bit 16 and FIGS. 2A-2C more closely show the drill bit 16. The single pass drilling apparatus 10 comprises several parts; e.g., an elongated drill steel 11 having a leading end 12 and a trailing end, not shown, reference being had to a drilling direction F. The leading end 12 has a connection portion comprising a thread, a taper or a bayonet connection, not shown. A one-piece drill bit 16 is provided having rock machining means 17 and 18A, 18B, 18C. The drill bit 16 is connectable to the drill steel via a connection portion comprising a thread, a taper or a bayonet connection (not shown). The drill steel 11 and the drill bit constitute drilling means. The single pass drilling apparatus 10 further comprises an anchor bolt 21 adapted to at least partially enclose the drill steel 11. The anchor bolt 21 has open ends. The greatest diametrical dimension of the drill bit is smaller than the smallest diameter of the anchor bolt 21.

The basic idea of the single pass drilling apparatus 10 is to drill the bore while the bolt encloses the drill steel, and then to retract the bit to be used again. There are no losses of bit parts. The single pass drilling apparatus 10 has been more closely described in Swedish Patent Application No. 0400597-1 (corresponding to WO 2005/085582) the disclosure of which is hereby incorporated by reference.

The drill bit 16 can be designed as follows, reference being had to FIGS. 2A to 2C. The one-piece drill bit 16 comprises a body 25 made of steel and the rock machining means 17, 18 disposed on the body. The body 25 has a leading end 27 and a trailing end 28 and incorporates two integral parts, i.e., a pilot part 14 long enough to guide the entire apparatus 10 properly where the axis CL1 of the pilot part 14 coincides with the axis CL3 of the bore 22, and a reamer part 19. The centre axis or middle line CL1 of the pilot part 14 substantially coincides with the centre axis of the rock bolt during drilling and therefore can be regarded as the drilling axis of the drill bit, but axis CL1 does not coincide with the axis CL3 during retraction of the drilling bit. The centre axis or middle line CL2 of the reamer part 19 and the axis of the drill steel 11 coincide, but are substantially spaced from the axis CL3 of the bore 22. It should be noted that neither the pilot part nor the reamer part has to be circular in cross-section, so reference to axes CL1 and CL2 shall be understood as reference to average middle lines in the respective parts.

The rock machining means are in the form of cemented carbide means, i.e., chisels and/or buttons. The pilot part 14 has a front face 29 which forms the leading end 27 of the bit 16 and carries a diametrically extending chisel or two diametrically opposed front buttons (given general reference 17). The reamer part has a front face 30 carrying a plurality of buttons 18; in this case three front buttons 18A, 18B and 18C. The buttons 18A, 18B and 18C may project somewhat outside the periphery of the reamer part in order to machine a bore 22 during drilling which has a bigger diameter than the steel body 25. The number of cemented carbide buttons in the reamer part can be varied depending on how great the diameter of the drill bit is. Chipways or recesses can be provided in areas between adjacent reamer buttons, through which flush medium can pass.

The rock drill bit 16 is to be coupled to the drill steel 11 by means of a connection portion, so as to transfer rotational movement and percussion in the usual manner. The drill steel 11 includes a channel for conveying a flush medium. A main channel for flush medium is provided inside the drill bit. This main channel communicates at its forward end with a number of branch channels, which exit in the front faces. The flush medium will in practice be water, cement or air.

The pilot part drills a pilot bore 22A of less diameter and length in relation to the bore 22. The length of the pilot part 14 is defined as the distance between the forwardmost portion of the pilot part and the forwardmost reamer button 18C, in a direction parallel to the reamer part centre line CL2. The length is at least 10 mm and not more than 60 mm to provide good guidance of and good service life for the drill bit.

The reamer buttons in this embodiment comprises a leading button 18A, and trailing buttons 18B and 18C (as the drill bit 16 is arranged to undergo left hand rotation under drilling). As best illustrated in FIGS. 2A to 2C, the buttons are angularly spaced about the drilling axis CL1 at equal spacings and are disposed in a sector S having a sector angle θ. The spacings may in some cases be different, i.e., not identical. It will be noted that the radial arms of the sector travel through the mid points of the respective extreme buttons 18A and 18C. This angle θ is less than 120° and preferably less than 90°. In the illustrated form, the angle is approximately 76°.

In addition to being angularly spaced, the buttons 18A, 18B and 18C are also axially spaced relative to one another. Again in the illustrated form, this axial displacement is constant with each of the trailing buttons 18B and 18C being spaced towards the leading end 27 of the drill bit 16 from its immediately preceding button. With this angular and axial spacing, the buttons 18A, 18B and 18C line on an arc that forms part of a helix PD having a constant radius and pitch, and having a pitch angle α inclined to a plane normal to the drilling axis. In the shown embodiment, there is the same altitude difference between buttons. The axial spacing may alternatively be different to get more flexibility regarding capability to perform well for a wider range of penetration rates, for instance. As will be discussed in more detail below with reference to FIG. 3, the pitch angle α changes the penetration profile of the drilling tip and the degree of pitch angle that is most effective depends on drilling conditions and, in particular, penetration rates. Typically the pitch angle α will be in the range of 5-10° with the illustrated form being approximately 8°.

Figure 3:
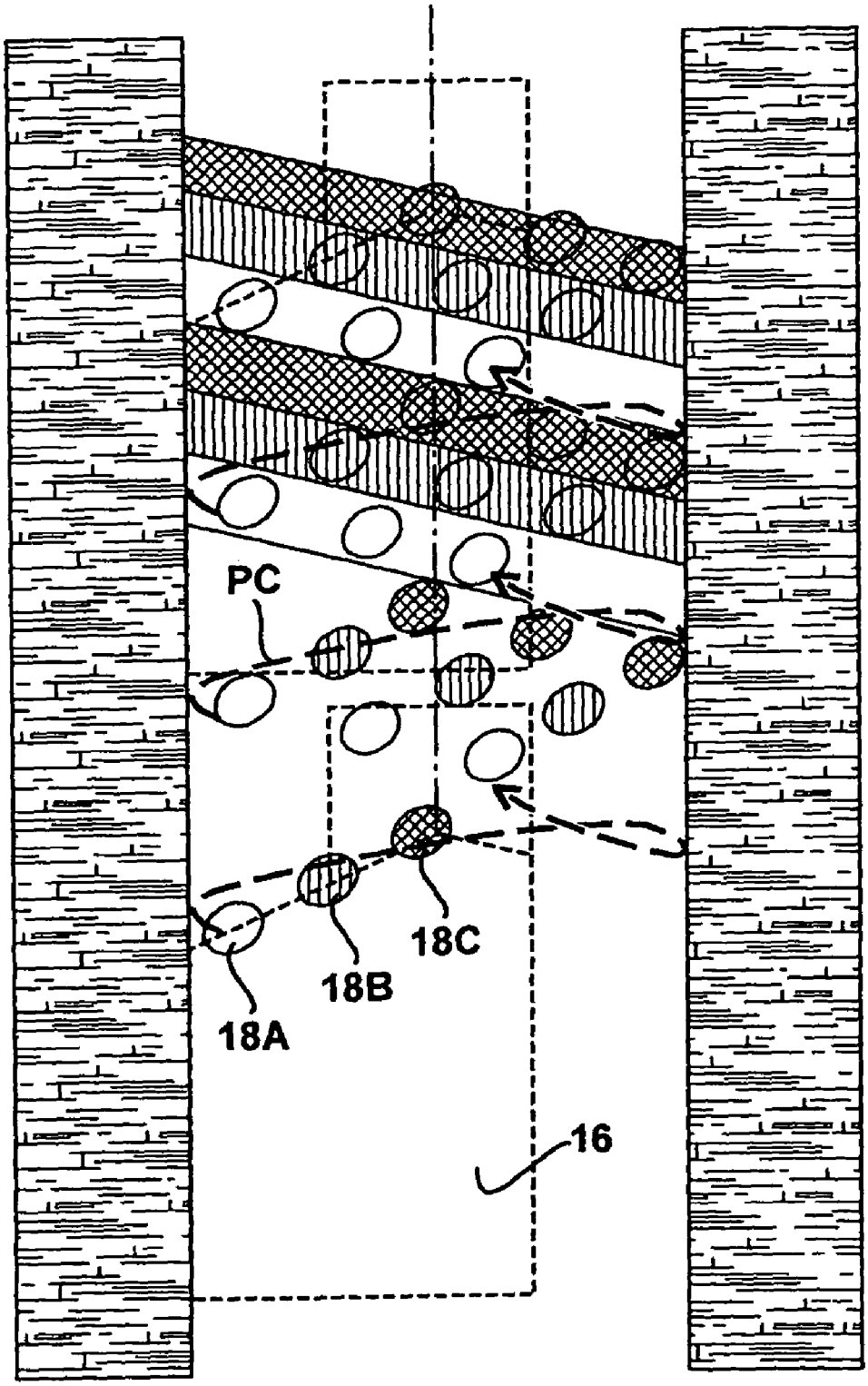
FIG. 3 is a schematic view of the drill bit during drilling of a bore in rock in a side elevational view.

The orientation of the reamer buttons 18A, 18B and 18C is designed to improve the effectiveness of the drilling bit particularly, as in the present case, where the reamer buttons 18A, 18B and 18C are confined to a small sector defined by sector angle θ. During drilling, the reamer buttons are both rotated (about axis CL1) and caused to impact the rock face. Each impact is caused to move the drilling bit in the drilling direction F. Consequently, this combined rotary and axial movement causes the reamer buttons 18A, 18B, and 18C to follow a generally helical path PC of constant radius and pitch as illustrated in FIG. 3. The anticipated pitch PC can be determined from the drilling speed (rate of penetration/time) and rate of rotation of the drill bit.

By forming the reamer buttons on the drill bit on an arc that forms part of a helix PD that is wound in the opposite direction to the expected helical cutting path PC, more effective drilling may be achieved as compared to the arrangement where the reamer buttons are aligned normal to the drilling axis. In particular, reamer buttons are better presented to the cutting face resulting in the reaction forces on the reamer 19 being more evenly distributed across each of the reamer buttons (18A, 18B, 18C) with each button needing to cut a substantially equal slice of rock. If the reamer buttons were normal to the drilling axis, then the majority of work is done by the leading button 18A. Moreover, displacing the reamer buttons axially by the amount D (see FIG. 3), which is close to the pitch of the cutting helix PC, enables the drill bit to move consistently through the rock on each revolution. In particular, there is no significant discontinuity between the end of one revolution and the start of the next revolution. As the reamer moves to the end of a revolution, the reamer buttons are presented to the rock face at the correct position to start the next revolution with no significantly large gap between the position of the leading button 18A at the end of a revolution and the position of the cutting face at the start of the revolution. Previously, where the reamer buttons were located normal to the drilling axis, there was a tendency for the drill bit to "bite" into the rock face as the reamer traveled into the rock under its helical cutting path PC.

It is to be appreciated that whilst optimal performance may be achieved where the distance D is established as a percentage of the pitch of the cutting helix PC (calculated from the sector angle θ), improved performance is achieved with some pitch (or axial displacement) being introduced on the reamer buttons as compared to an arrangement where there is no such displacement. Accordingly, the invention is not limited to a specific relationship between distance D and the expected cutting helix path PC.

To support the drill bit in the bore during drilling, an outer surface 31 of the drill bit incorporates at least one bearing region 32 which in use is arranged to bear against the inner wall of the bore thereby assisting in maintaining the bit in its correct orientation. In the present form, this bearing region is disposed along the length of the surface of the drill bit 16 under the reamer part 19. This region forms part of the skirt that locates around the drill steel 11. In another form, the bearing region may be disposed on only a portion of the reamer outer surface, for example, immediately under the reamer buttons 18 and/or adjacent the trailing end 28 of the drill bit 16.

Figure 4:
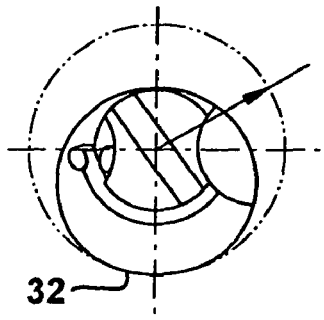
FIG. 4 shows the drill bit in a front view in relation to a bore profile.

As will be appreciated, the cross-section (normal to the drilling axis) is such that the radial distance of the outer surface from the drilling axis varies about the bit. The bearing region 32 is disposed at the outermost part of the drill bit surface 31 and is configured so as to extend angularly about the drilling axis at a constant radial distance. This radial distance corresponds to the radius of the bore 22 formed by the reamer part 19. This is best illustrated in FIG. 4.

The bearing region 32 typically includes wear resisting means so as to be of a harder material than the main bit body. Whilst the bearing region 32 may be generally linear extending about the drilling axis (and be in the form of a ridge or rib or the like), in the illustrated form, the bearing region also extends axially relative to the drilling axis and is therefore in the form of a bearing surface. This bearing surface may extend from the leading to trailing end of the reamer part, only part way along the surface, or as mentioned above may be in separate sections to form a plurality of bearing regions.

The operation of the single pass rock bolting apparatus 10 is shown in FIGS. 1A-1G. The drill bit 16 is connected, for example threaded, to the drill steel 11. A drilling machine, such as a standard drill jumbo, holds the drill steel. The bolt 21 is preferably automatically fed around the drill steel and positioned behind the drill bit 16 in the drilling direction F. In FIG. 1A the pilot part 14 primarily will abut against the rock such that for a short while it will machine the rock surface during circular interpolation. Then the pilot part 14 will find its correct centre and begin to drill centrally while the drill steel 11 simultaneously starts wobbling about the pilot part middle line CL1. Then the reamer part 19 gets in contact with the rock surface and begins to ream the hole made by the pilot part 14 with the bearing region 32 locating against the inner wall of the bore 22 to support the drill bit 16. After a short while, the bolt 21 reaches the hole and is forced into the hole as shown in FIG. 1C. Usually the bolt 21 is spaced axially from the drill bit 16. The bolt 21 diameter is preferably less than that of the bore 22. The drill bit 16 will continue to drill and ream the bore 22, while the bolt is pushed forwardly by a coupling sleeve 26 of the drilling machine, see FIG. 1D, until feed of the different parts is stopped. The depth of the bore 22 is substantially determined by the length of the bolt 21, i.e., when a washer 23 positioned at the trailing end of the bolt reaches the rock face or entrance of the bore further feed will be stopped, see FIG. 1E. There is an anchor bolt pusher on the drilling machine. The bolt pusher is a coupling sleeve 26 or a dolly tool, which is driven by the drill steel. The dolly tool usually rotates together with the drill steel and the bolt during insertion. However, for instance, the bolt may be held such that it does not rotate during insertion, e.g., in the case of a mechanical anchor bolt. The dolly tool can torque the anchor bolt when fully inserted. The dolly tool can also slide along the drill steel to allow an easier installation of mechanical shell bolts and grouted bolts. FIG. 1E shows the anchor bolt 21 fully inserted, with the drill steel and drill bit still in the anchor bolt. A pusher pushes the plate to the rock face. The washer could be a loose conventional plate having a central hole that cooperates with a bulge 24 at the trailing end of the bolt. Then the drill bit is retracted from the pilot hole 22A, see FIG. 1F. It is preferable that the axial space between the bolt and the drill bit is greater than the depth of the pilot bore 22A such that the leading end of the bolt does not interfere with the retraction of the drill bit. The drill bit and the drill steel can be completely retracted and can be reused for repeated drilling operations.

The machine driving the apparatus 10 can be a top hammer drilling machine, a pure rotary machine or a down-the-hole equipment.

Exemplary embodiments of the disclosed drill bit provide good cutting and guiding and provide favorable drilling results.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A drill bit rotatable about a drilling axis, comprising:

a bit body including a reamer part;

a leading end and a trailing end spaced apart in a direction of the drill axis; and a plurality of first rock machining means disposed on the reamer part, wherein the plurality of first rock machining means include, relative to a direction of rotation, a leading first rock machining means and at least one trailing first rock machining means, the leading first rock machining means and the trailing first rock machining means are angularly spaced apart from one another about the drill axis, wherein at least one of the trailing first rock machining means is also axially spaced from the leading first rock machining means in a direction towards the leading end of the drill bit, and wherein the bit body has an outer surface extending between said leading and trailing ends and which, in a cross-section perpendicular to the drilling axis, is not uniformly radially displaced from the drilling axis, the outer surface incorporating a bearing region which forms the outermost radial part of the outer surface, wherein the bearing region extends angularly about the drilling axis.

2. The drill bit according to claim 1, wherein the angular spacing between each trailing first rock machining means and its immediately preceding first rock machining means is the same.

3. The drill bit according to claim 2, wherein each of the trailing first rock machining means is axially spaced apart in the direction towards the leading end from its immediately preceding first rock machining means.

4. The drill bit according to claim 3, wherein the axial spacing between each trailing first rock machining means and its immediately preceding first rock machining means is the same.

5. The drill bit according to claim 2, wherein the angular and axial spacing of the plurality of first rock machining means are such that the plurality of first rock machining means are disposed on the bit body in an arc of a helix having a substantially constant radius and pitch.

6. The drill bit according to claim 2, wherein the plurality of first rock machining means are disposed about the drilling axis within a sector having a sector angle θ.

7. A single pass drilling apparatus comprising drilling means and an anchor bolt, wherein the apparatus comprises a drill bit as defined in claim 2.

8. The single pass drilling apparatus according to claim 7, wherein the drill bit is a one-piece drill bit.

9. The drill bit according to claim 1, wherein each of the trailing first rock machining means is axially spaced apart in the direction towards the leading end from its immediately preceding first rock machining means.

10. The drill bit according to claim 9, wherein the axial spacing between each trailing first rock machining means and its immediately preceding first rock machining means is the same.

11. The drill bit according to claim 9, wherein the angular and axial spacing of the plurality of first rock machining means are such that the plurality of first rock machining means are disposed on the bit body in an arc of a helix having a substantially constant radius and pitch.

12. The drill bit according to claim 9, wherein the plurality of first rock machining means are disposed about the drilling axis within a sector having a sector angle θ.

13. A single pass drilling apparatus comprising drilling means and an anchor bolt, wherein the apparatus comprises a drill bit as defined in claim 9.

14. The single pass drilling apparatus according to claim 13, wherein the drill bit is a one-piece drill bit.

15. The drill bit according to claim 1, wherein the angular and axial spacing of the plurality of first rock machining means are such that the plurality of first rock machining means are disposed on the bit body in an arc of a helix having a substantially constant radius and pitch.

16. The drill bit according to claim 15, wherein the angle of the pitch relative to a plane normal to the drilling axis is in the order of 5° to 10°.

17. The drill bit according to claim 15, wherein the plurality of first rock machining means are disposed about the drilling axis within a sector having a sector angle θ.

18. A single pass drilling apparatus comprising drilling means and an anchor bolt, wherein the apparatus comprises a drill bit as defined in claim 15.

19. The single pass drilling apparatus according to claim 18, wherein the drill bit is a one-piece drill bit.

20. The drill bit according to claim 1, wherein the plurality of first rock machining means are disposed about the drilling axis within a sector having a sector angle θ.

21. The drill bit according to claim 20, wherein the sector angle θis less than 120° and preferably less than 90°.

22. A single pass drilling apparatus comprising drilling means and an anchor bolt, wherein the apparatus comprises a drill bit as defined in claim 20.

23. The single pass drilling apparatus according to claim 22, wherein the drill bit is a one-piece drill bit.

24. The drill bit according to claim 1, including a pilot part disposed on the drilling axis, wherein the reamer part is radially offset from the pilot part and includes an end surface on which the plurality of first rock machining means are disposed, and wherein the pilot part is axially displaced from the reamer part in the direction of the leading end.

25. The drill bit according to 24, wherein the bearing region is formed on the reamer part.

26. The drill bit according to claim 25, wherein the bearing region includes wear resisting means.

27. The drill bit according to claim 25, wherein the bearing region is disposed adjacent the trailing end of the drill bit.

28. A single pass drilling apparatus comprising drilling means and an anchor bolt, wherein the apparatus comprises a drill bit as defined in claim 24.

29. The single pass drilling apparatus according to claim 28, wherein the drill bit is a one-piece drill bit.

30. The drill bit according to claim 24, wherein second rock machining means are disposed on a front face of the pilot part.

31. The drill bit according to claim 1, wherein the bearing region also extends axially relative to the drilling axis so as to form a bearing surface.

32. A single pass drilling apparatus comprising drilling means and an anchor bolt, wherein the apparatus comprises a drill bit as defined in claim 1.

33. The single pass drilling apparatus according to claim 32, wherein the drill bit is a one-piece drill bit.

34. The drill bit according to claim 1, wherein the plurality of first rock machining means are disposed on a front face of the reamer part.

35. The drill bit according to claim 1, wherein the bearing region extends only part way along the outer surface extending between said leading and trailing ends.

36. The drill bit according to claim 1, wherein the bearing region includes separate sections forming a plurality of bearing regions.

37. A single pass drilling apparatus comprising drilling means and an anchor bolt, wherein the apparatus comprises a drill bit, wherein the drill bit is rotatable about a drilling axis and includes:

a bit body including a reamer part;

a leading end and a trailing end spaced apart in a direction of the drill axis; and a plurality of first rock machining means disposed on the reamer part, wherein the plurality of first rock machining means include, relative to a direction of rotation, a leading first rock machining means and at least one trailing first rock machining means, the leading first rock machining means and the trailing first rock machining means are angularly spaced apart from one another about the drill axis, and wherein at least one of the trailing first rock machining means is also axially spaced from the leading first rock machining means in a direction towards the leading end of the drill bit.

38. The single pass drilling apparatus according to claim 37, wherein the drill bit is a one-piece drill bit.

* * * * *